United States Patent [19]

Molnar

[11] Patent Number: 4,618,511

[45] Date of Patent: Oct. 21, 1986

[54] METHOD FOR APPLYING NON-SKID COATING TO METAL BARS WITH ELECTRIC ARC OR GAS FLAME SPRAY AND ARTICLE FORMED THEREBY

[76] Inventor: William S. Molnar, 3565 Roland Dr., Birmingham, Mich. 48010

[21] Appl. No.: 739,692

[22] Filed: May 31, 1985

[51] Int. Cl.[4] ..... B05D 1/08

[52] U.S. Cl. ..... 427/203; 427/204; 427/205; 427/423; 118/500; 118/504

[58] Field of Search ..... 427/196, 204, 203, 205, 427/284, 423, 34, 37; 118/301, 500, 504

[56] References Cited

U.S. PATENT DOCUMENTS

| | | | |
|---|---|---|---|
| 3,097,959 | 7/1963 | Zachman | 118/301 |
| 3,325,303 | 6/1967 | Lant et al. | 427/423 X |
| 3,399,649 | 9/1968 | Kidgell et al. | 118/321 X |
| 4,032,672 | 6/1977 | McCormick | 427/423 X |
| 4,284,658 | 8/1981 | Davis et al. | 427/423 |

*Primary Examiner*—Shrive P. Beck

*Attorney, Agent, or Firm*—Harness, Dickey & Pierce

[57] ABSTRACT

A process for forming metal bars with a non-skid coat by arranging a plurality of the bars in a side-by-side assembly and thermally applying a metallic spray coat simultaneously to a plurality of the bars while inhibiting bridging of the spray material across adjacent bars.

30 Claims, 17 Drawing Figures

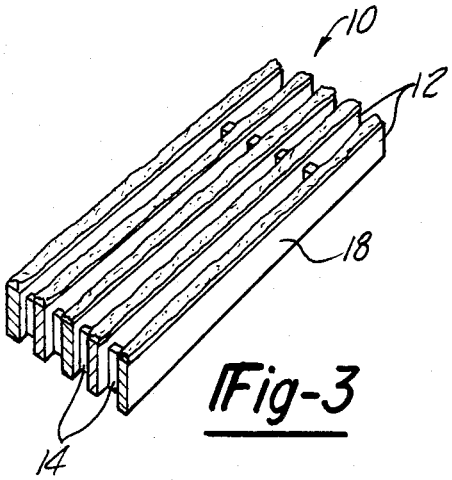
Fig-3
Fig-1
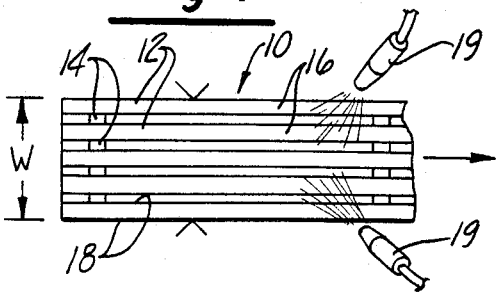
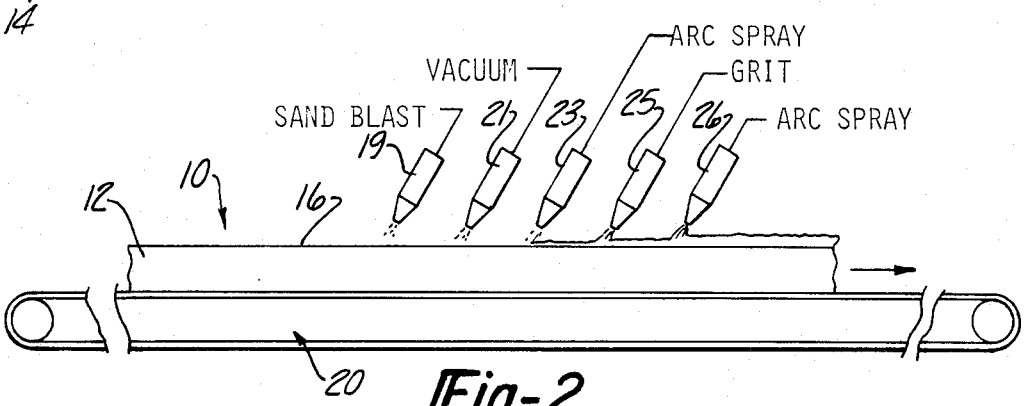
Fig-2
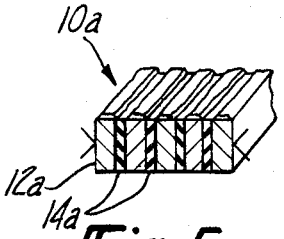
Fig-5
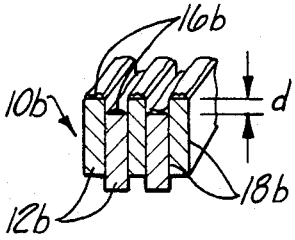
Fig-6
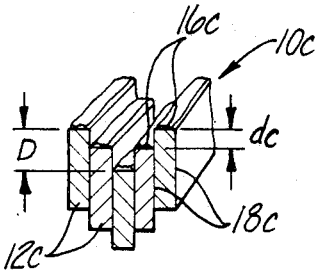
Fig-7
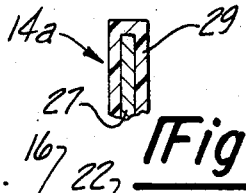
Fig-5A
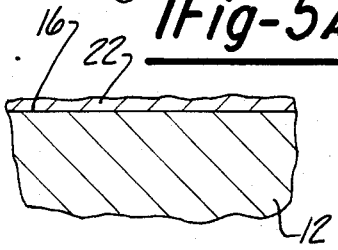
Fig-4A
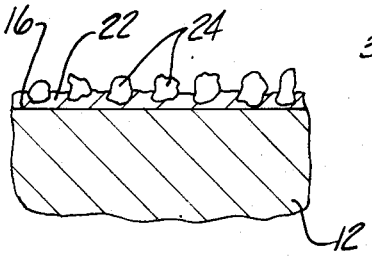
Fig-4B
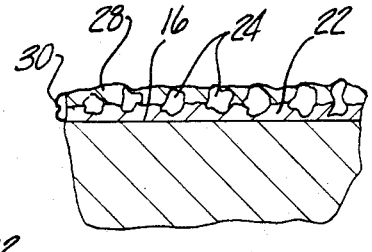
Fig-4C

METHOD FOR APPLYING NON-SKID COATING TO METAL BARS WITH ELECTRIC ARC OR GAS FLAME SPRAY AND ARTICLE FORMED THEREBY

SUMMARY

Background of the Invention

The present invention relates to articles and a method of manufacturing articles having a non-skid surfaces and more particularly structures, such as grating and the like, made of bar material having a non-skid surface and a method of manufacturing such structure, where such method involves the deposition of a thermally softened metallic layer by electric arc, gas flame spray or other thermal spray.

Methods of applying non-skid coatings to metal surfaces by electric arc spray are well known as exemplified by the U.S. Patents to Palena U.S. Pat. No. 4,029,852 issued June 14, 1977 and U.S. Pat. No. 3,855,444 issued Dec. 17, 1974. While these methods are effective for applying non-skid coatings to substantially wide surfaces of metal panels or sheets, the use of these methods for coating the end surfaces of relatively narrow metal bars can be generally inefficient. In this regard bars for use in grating and the like would have end surfaces between around $\frac{1}{8}''$ to around $\frac{3}{8}''$ thick although bars as thick as $\frac{1}{2}''$ to 1" have practical use as well. One problem in coating the narrow end surfaces of bars is to efficiently utilize the spray materials which can be metal droplets which are arc or otherwise thermally sprayed from wire typically made of aluminum, steel or other suitable material. If bars are processed one at a time, then there is not only the inefficiency in handling but also in the utilization of spray materials resulting from spray scatter. If a plurality of bars were clamped together and processed simultaneously, the spray material could bridge over and a separation step would be involved that could require additional processing for removal burrs etc., and could also result in damage to the coating as by tearing over from one bar to another.

In addition, where the non-skid surface is desired to be formed with a grit along with the spray material, there would be a problem in applying the grit to the narrow end surface and keeping it generally uniformly dispersed during processing.

In the present invention, the processing of the narrow end surfaces of bars is facilitated by a unique spacing of adjacent bars to maximize the use of the spray materials and to eliminate or minimize bridging of the spray material. In another approach, adjacent bars are continuously oscillated slightly relative to each during spray to thereby inhibit the formation of a bridge between bars. While the present invention is most advantageously used with bars having end surfaces of between around $\frac{1}{8}''$ to around $\frac{3}{8}''$ thick, the invention can be practically used for bars as thick as around $\frac{1}{2}''$ to 1".

Therefore it is an object of the present invention to provide a novel method for applying a non-skid surface by an electric arc, gas spray, or other thermal spray of metallic material simultaneously to the narrow end surfaces of a plurality of bars while inhibiting bridging between bars.

It is another object to provide a novel product by process for applying a non-skid surface by a thermal spray of metallic material simultaneously to the narrow end surfaces of a plurality of bars while inhibiting bridging between bars.

Other objects, features, and advantages of the present invention will become apparent from the subsequent description and the appended claims, taken in conjunction with the accompanying drawings, in which:

FIG. 1 is a top elevational view depicting an assembly of a plurality of metal bars and apparatus for applying non-skid coating to the narrow end surfaces of the bars in accordance with one form of the present invention;

FIG. 2 is a side elevational view of the assembly of metal bars and the apparatus of FIG. 1;

FIG. 3 is a pictorial view of the plurality of metal bars of FIGS. 1 and 2 after the non-skid coating has been applied;

FIGS. 4A–4C are longitudinal sectional views to enlarged scale depicting the coating on one of the metal bars of FIG. 1 at various stages of processing;

FIG. 5 is a fragmentary pictorial view similar to FIG. 3 of a different arrangement of a plurality of metal bars for processing similar to that shown in FIGS. 1 and 2;

FIG. 5A is a fragmentary view to enlarged scale of spacers utilized on the bar assembly of FIG. 5;

FIG. 6 is a fragmentary pictorial view similar to FIG. 3 of another arrangement of a plurality of metal bars for processing similar to that shown in FIGS. 1 and 2;

FIG. 7 is a fragmentary pictorial view similar to FIG. 3 of another arrangement of a plurality of metal bars for processing similar to that as shown in FIGS. 1 and 2;

Figure 8:
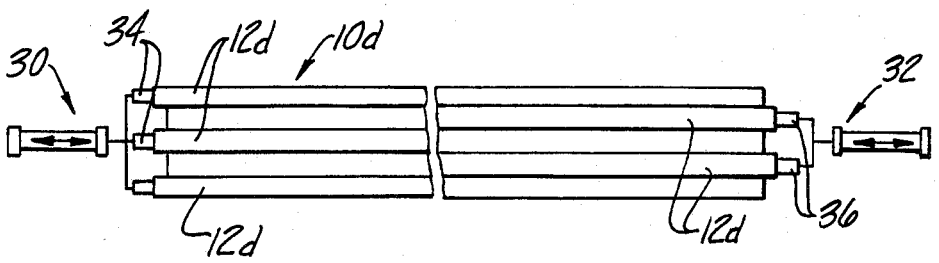
FIG. 8 is a top elevational view illustrating a form of the invention in which alternate ones of a plurality of bars are reciprocated longitudinally during processing to inhibit bridging of the spray coat.

In applying a non-skid coating to sheets and panels by electric or gas arc spray, it is common for the apparatus to handle sheets approximately 48" in width and 24' in length. As will be seen, with the present invention a plurality of bars having an overall width of around 48" and length of 24' can be processed.

In this regard it should be noted that bars are typically 1" wide (or deep) although bars of greater width can be used; as noted, such bars for grate constructions have an end surface thickness of around $\frac{1}{8}''$ to around $\frac{3}{8}''$ although bars having a thickness up to between $\frac{1}{2}''$ to 1" can also be advantageously coated with the system of the present invention. For the purpose of this invention the bars are preferably made of steel but other metals, such as aluminum, suitable for electric arc, gas flame spray or other thermal spray processing can be used.

Looking now to FIG. 1, a bar assembly 10 is shown comprising a plurality of metal bars 12 which are clamped together and held spaced apart by spacers 14. The overall width W of bar assembly 10 is preferably between about 12" to around 48". Each of the metal bars 12 has an upper, end surface 16 to which a non-skid coat is to be applied. As shown in FIGS. 1 and 2, the spacers 14 are located at intervals and are substantially below the end surface 16 so as not to be affected by the subsequent processing. Alternatively, the spacers 14 can extend co-extensively with the length of the metal bars 12.

Prior to applying the non-skid coat to the end surfaces 16 of the bars 12, these surfaces are cleaned, ground and preferably roughened as by grit blasting, etc. As will be seen it is preferred that only the end surface 16 be so prepared in this manner and that the adjacent side surfaces 18 be maintained in their original condition and/or with a light coating of oil or other spray resistant substances. In this way, as will be seen, adherence of the spray coat to the side surfaces 18 will be inhibited.

The bar assembly 10 is located on a movable bed or conveyor 20 with the end surfaces 16 up or exposed. The cleaning, grinding and grit blasting can be performed on the bars 12 in the assembly 10 on the conveyor 20. As shown in FIG. 1, the end surfaces 16 of bars 12 are roughened by grit blasting apparatus 19 with particles being removed as by a vacuum 21.

A first electric arc spray apparatus 23 is located over the conveyor 20 and hence over the end surfaces 16. The spray assembly 23 directs a spray of metal droplets onto the end surfaces 16. Typically the metal droplets are formed from aluminum or steel wire by an electric or gas arc with the droplets directed towards the end surfaces 16 by air (or other suitable gas) under pressure. The gas pressure, arcing amperage and the relative distance from the spray apparatus 23 to the end surfaces 16 are selected such that the metal droplets are in a thermally softened or plastic state as they impinge the surfaces 16 and form a first coat 22 (see FIG. 4A). Next, grit dispensing apparatus 25 applies a coating of grit 24 (see FIG. 4B) to the surface 16 and to the first coat 22 while the first coat 22 is still in a thermally plastic state. This forms a preliminary bond between first coat 22 and the grit coat 24. The grit 24 can be aluminum oxide particles, sand or other suitable material that will not degrade under the temperatures involved i.e. around 300° F.

The bar assembly 10 is now conveyed to a second spray stage where a second arc spray apparatus 26, applies a second metallic coat 28 to generally cover the grit coat 24 and the first coat 22 and to provide a final non-skid coat 30. While aluminum can be used for both the first coat 22 and the second coat 28 other metals could be used and different metals could be used for the first and second coats 20, 28.

In order to avoid bridging of the coat 30 between adjacent ones of the bars 12, the spacers 14 are selected to space the bars 12 transversely from each other a distance greater than around 0.07" but not greater than around 0.20". With a spacing of around 0.07" some bridging may occur. With a spacing significantly greater than around 0.20" an excessive amount of the spray material (such as aluminum) will be lost in the gap between bars.

By selectively restricting the cleaning, grinding and roughening steps to the upper surface 16 of the metal bars 12 and leaving the side surfaces 18 in their natural state or providing them with a light oil or other spray resistant coat, the adherence of the spray material to the side surfaces 18 will be inhibited thereby inhibiting bridging of the non-skid coat 30 across the gaps and between adjacent bars 12. Also the grit size should preferably be around a No. 16 to around a No. 20 grit or having a diameter of from around 0.5 mm. to around 1.0 mm.

After completion of the processing as noted, the bars 12 can be removed from the assembly 10 and fabricated to form an open grate or other product where a relatively narrow end surface with a non-skid coat is desired.

It should be noted while the above process of FIGS. 1–4 depicts the application of a grit layer; in some applications this may not be necessary and hence the surface provided by the spray coats 22 and 28 would provide an adequately roughened surface. Also while the process of FIGS. 1–4 employs a step in which the bar end surface 16 is roughened, after cleaning and grinding, in some applications and with selected spray materials the roughening step can be omitted. Thus, when the bars 12 are constructed of a ferrous material, the surface roughening step can be omitted by use of a spray material such as 75B Bond Arc provided by TAFA Incorporated of Bow, N.H., and as described in their bulletin titled "Application Data" File 2.9.6, issued Aug. 4, 1983 and bearing a 1983 Copyright notice.

FIG. 5 depicts an arrangement with bars in which spacers are utilized to extend longitudinally for the length of the bars. Thus bars **12*a* are transversely spaced the desired distance by longitudially extending spacers 14*a*. The spacers 14*a* extend longitudinally generally co-extensively with the bars 12*a* with their uppermost edges being proximate the end surfaces 16. In this way the side surfaces 18*a* of the bars are shielded from the metallic spray materials. The spacers 14*a* are constructed of a material which will not accept the metallic spray materials; for this purpose the spacers 14*a* can be of a construction shown in FIG. 5A and comprises a steel strap 27 having a plastic coating 29** constructed of a polyfuoro-olefin resin such as TEFLON; TEFLON is the trademark of E. I. DuPont de Nemours.

FIGS. 6 and 7 depict arrangements with bars in an assembly in which spacers such as 14 or **14*a* are not required. Thus in FIG. 6 the bars 12*b* are arranged in an assembly 10*b* in which the bars 12*b* are alternately, vertically or laterally staggered relative to each other such that every other one of the bars 12*b* has its end surfaces 16*b* below the adjacent ones of the bars 12*b*. With the arrangement in FIG. 6 the side surfaces 18*b* have a spray resistant coating such as a thin oil film. In some cases it may be sufficient to simply shield the side surfaces from prior abrading and/or grit blasting and rely on the inherent coating possessed by the bars. In any event, the end surfaces 16*b* are prepared in the same manner as the end surfaces 16 of FIGS. 1–4. The assembly 10*b* is then coated in the manner as described with regard to the embodiment of FIG. 1–4. Note that the grit (such as grit 24) will adhere to the first metallic coat (such as coat 22) and provide a relatively uniform grit layer even though alternate ones of the bars 12*b* are depressed. The spray resistant coating on the side surfaces 18*b* will inhibit the attachment between adjacent bars 12*b* by the first spray coat (such as coat 22) and the second spray coat (such as coat 28). In order to inhibit the formation of a bridge between end surfaces 16*b* on adjacent bars 12*b* while still providing for generally even coating between the depressed and non-depressed bars 12*b***, the depth d of offset is maintained in a range of between around 0.7" to around 0.20".

FIG. 7 shows another arrangement of an assembly 10c in which the bars 12c are vertically or laterally staggered relative to each other such that a number of the bars 12c are depressed to form a series of steps down and a similar number raised to form a series of steps up. While the individual depth dc between end surfaces 16c is maintained in a range of between around 0.07" to around 0.20" (as with FIG. 6) the total overall depth D between the uppermost end surface and lowermost end surface is maintained between around ⅜" and around ⅝". As with the embodiment of FIG. 6, the side surfaces 18c are coated or are maintained in a condition such as to inhibit the adherence of the spray material. The bar assembly 10c can be processed and hence coated in a manner as described with regard to the embodiment of FIGS. 1–4.

FIG. 8 depicts a different form of the invention. Here the assembly 10d holds the bars 12d generally loosely so that they can be moved relatively to each other. Drive mechanisms 30 and 32 are located at opposite ends of the bar assembly 10d and drive mechanism 30 has fingers or rollers 34, which are adapted to engage alternate ones of the bars 12d while drive mechanism 32 has fingers or rollers 36 adapted to engage the others of the bars 12d. As the assembly 10d is moved along by the conveyor (such as conveyor 20) through the various coating stages, the drive mechanisms 30 and 32, which operate in synchronism, reciprocate the alternate bars longitudinally such that bridging during the spray coating stage is inhibited. The drive mechanisms 30 and 32 are synchronized such that there is always some relative movement between adjacent bars 12d. Thus when mechanism 30 reaches the end of its stroke in one direction and is momentarily stopped to reverse directions, drive mechanism 32 will be operative to have its associated bars 12d, moving, preferably at the maximum velocity in its stroke. The assembly 10d could take the arrangement of bars shown in FIG. 5 without spacers *(such as spacer 14a). However spacers such as 14a have good lubricity characteristics and could be provided to facilitate relative movement between adjacent bars. In the latter instance the spacer thickness could be nominal i.e. around the 0.07" spacing for stationary bars. Similarly the system of FIG. 8 could be used with the arrangement of assemblies 10b and 10c of FIGS. 6 and 7 to further inhibit bridging.

Figure 9:
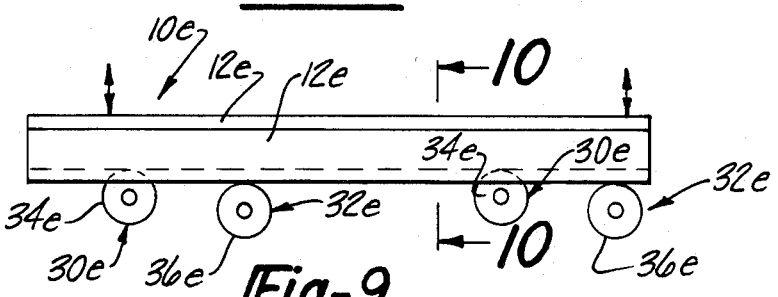
FIG. 9 is a side elevational view illustrating a form of the invention to which alternate ones of a plurality of bars are reciprocated vertically or laterally during processing to inhibit bridging of the spray coat.
Figure 10:
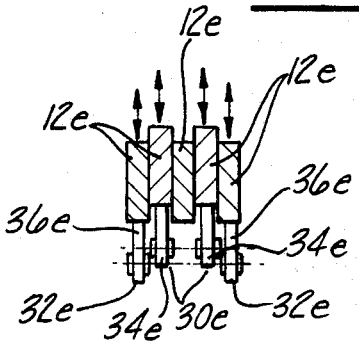
FIG. 10 is a sectional view of the bars and apparatus of FIG. 9 taken generally along the line 10—10 in FIG. 9.

FIGS. 9 and 10 depict a form similar to that of FIG. 8 but here the drive mechanisms 30e and 32e have rollers or fingers 34e and 36e, respectively, which drive alternate bars 12e vertically or laterally relative to each other as the bars 12e pass through the spray coating stages. Again the mechanisms 30e and 32e are synchronized such that when the vertical motion of those bars 12e driven by mechanism 30e are momentarily stopped as mechanism 30e changes its direction of motion, the drive mechanism 32e will be moving its associated bars 12e, preferably at the maximum velocity in its stroke.

The various arrangements of the bar assembly 10e can be similar to that discussed with regard to the embodiments of FIG. 8.

Figure 11:
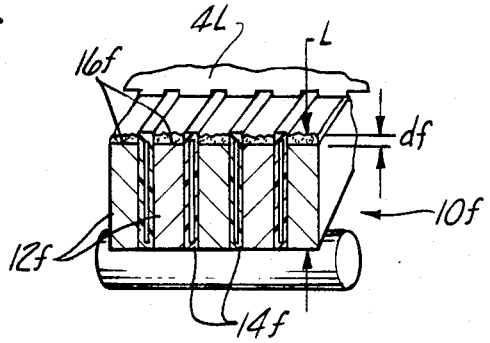
FIG. 11 is a pictorial view similar to that of FIG. 3 depicting another arrangement of bars for applying a non-skid coat by a different series of steps.

FIG. 11 shows a still different arrangement. The bar assembly 10f has the bars 12f in a uniform alignment similar to that shown in FIG. 5. Here, however, spacers 14f extend vertically above the bar end surfaces 16f. The distance df of this extension is generally between around 0.150" and to around 0.30" to inhibit bridging of the spray coat. Because of the vertical extension of the spacers 14f above the end surfaces 16f, the thickness of the spacers 14f can be minimal, i.e. around 0.07", since the criticality of bar spacing is reduced. In some applications, i.e. where grit is not to be applied, the vertical extension, can be selected to be between 0.07" to inhibit bridging.

Figure 12A:
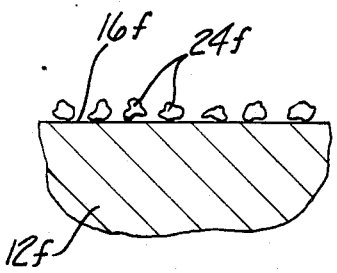
FIGS. 12A–12C are longitudinal sectional views to enlarged scale depicting the coating on the metal bars of FIG. 11 at various stages of a modified process.
Figure 12B:
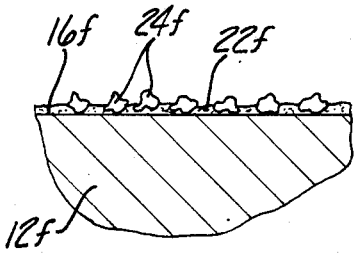
Figure 12C:
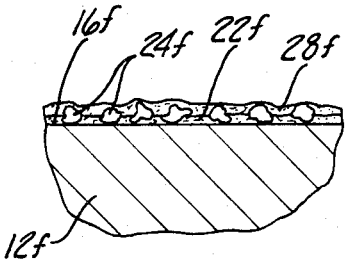

The surface coating, where grit is to be applied, can follow the steps shown in FIGS. 1, 2 and 4A–4C. However, with the use of spacers 14f arranged as shown, it is not necessary that th grit layer be applied after a first spray coat. Thus a sequence as shown in FIGS. 12A–12C could be employed. Here the grit 24f is applied directly to the end surfaces 16f prior to a metallic coating. The spacers 14f act as retaining walls to hold the grip 24f. Next the first metallic spray coat 22f is applied to provide a light layer of material to lock the grit 24f to the end surfaces 16f. Here the arc spray apparatus (such as apparatus 23) for the first or locking coat will be located farther from the grip 24f on end surfaces 16f such that the velocity of the impinging spray droplets and associated gas will not appreciably disturb the loose grit layer. Thus the first arc spray apparatus could be located round 18" from the end surfaces 16f while the second arc spray apparatus would be located around 5" from the end surfaces 16f. After the locking has occured, a second heavier layer 28f of spray material is applied. As noted the spray apparatus (such as apparatus 26) can now be closer to the surface being sprayed since the grit 24f is held from movement.

The spacers 14f are of a construction such as that of spacer 14a and hence are of a material which will not accept the metallic spray particles and can withstand the temperature involved.

It is desirable that the height of the finished coat be generally a uniform distance L from the bottom surface of each of the bars 12f. This facilitates later processing into the final grate form. Thus the bars 12f at the stages of grit application and spray coating are passed over leveling rollers such as roller 40. The bars 12f are leveled as they pass over rollers 40 and any discrepancies in bar width (or depth) will be reflected at the relative location of the upper bar surfaces 16f. An excess of grit is applied to the surfaces 12f and is leveled relative to each bar 12f such that the final height L will be more nearly the same between bars 12f. This is performed by a toothed structure 4L which is located at a preselected distance from the surface of rollers 40 such that the grit will be leveled to provide the desired overall height L for each of the bars 12f.

Thus a novel process is shown wherein a product from bar material is formed having a non-skid coating on its narrow end surface and wherein the product can be efficiently manufactured. Note that while two metallic spray coats have been shown additional coats could be applied as desired.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. A process for forming metal bars with non-skid coating on the narrow end surfaces of the metal bars comprising the steps of providing a plurality of longitudinally extending metal bars each having side surfaces and a top end surface to be coated, with said end surface having a thickness in a range of between around $\frac{1}{8}''$ to around 1", processing said end surfaces to provide a clean, roughened surface finish, arranging said metal bars in an assembly having an overall width of between around 24" to around 48" with said bars being oriented in a side by side relationhip with each of said end surfaces being exposed in the same direction, said bars as assembled having adjacent ones of said end surfaces spaced from each other a distance of between around 0.07" to around 0.20", applying a first metallic coat on said end surfaces by a first thermal spray, applying a coat of grit onto said first metallic coat while said first metallic coat is still in a thermally plastic state whereby said grit will adhere to said first metallic coat, applying a second metallic coat by a second thermal spray over said grit coat and said first metallic coat, and fabricating the resultant coated bars into a finished product.

2. The process of claim 1 with said end surfaces of said metal bars being transversely spaced to provide said distance of between around 0.07" to around 0.20".

3. The process of claim 1 with said end surfaces of said metal bars being laterally spaced to provide said distance of between 0.7" to around 0.20".

4. The process of claim 1 with said end surfaces of said metal bars being laterally spaced to provide said distance of between 0.07" to around 0.20", a group of at least three of said metal bars in immediate sequence being laterally spaced said distance in a step fashion.

5. The process of claim 4 with the maximum overall lateral spacing between said end surfaces of said bars in said group being no greater than between around $\frac{3}{8}''$ and $\frac{5}{8}''$.

6. The process of claim 1 with said side surfaces having a coating thereon adapted to resist adherence of thermal spray material from said first and second thermal sprays.

7. The process of claim 1 with said metal bars being transversely spaced by spacers extending longitudinally generally co-extensively with said metal bars.

8. The process of claim 1 with said metal bars being transversely spaced by spacers extending longitudinally generally co-extensively with said bars, said spacers having exposed surfaces open to said first and second thermal sprays which are adapted to resist adherence of thermal spray material from said first and second thermal sprays.

9. The process of claim 1 with said metal bars being transversely spaced by spacers extending longitudinally generally co-extensively with said metal bars, said spacers having exposed surfaces open to said first and second thermal sprays which are adapted to resist adherence of thermal spray material from said first and second thermal sprays, said spacers comprising a metal strap with a spray resistant coating supported thereon to define said exposed surfaces.

10. The process of claim 1 comprising moving means for causing relative movement adjacent ones of said bars during application of said first and second thermal sprays whereby bridging of said first and second metallic coats across said adjacent ones of said bars is inhibited.

11. The process of claim 1 comprising moving means for causing relative movement between adjacent ones of said bars during application of said first and second thermal sprays, said moving means applying said relative movement laterally between said adjacent bars.

12. A process for forming metal bars with a non-skid coating on the narrow end surfaces of the metal bars comprising the steps of providing a plurality of longitudinally extending metal bars each having side surfaces and a top end surface to be coated, with said end surface having a thickness in a range of between around $\frac{1}{8}''$ to around 1", processing said end surfaces to provide a clean surface finish, arranging said metal bars in an assembly having an overall width greater than around 24" with said bars being oriented in a side by side relationship with each of said end surfaces being exposed in the same direction, said bars as assembled having adjacent ones of said end surfaces spaced from each other a distance of between around 0.07" to around 0.20", providing a plurality thermally spray means for applying at least two metallic coatings on said end surfaces, moving said bars as assembled longitudinally relative to said thermal spray means, operating said plurality of thermal spray means as said bars are moved relatively thereto to successively and substantially simultaneously apply said two metallic coatings on said end surfaces of said bars with the second of said two metallic coatings being of an increased thickness relative to the first, and fabricating the resultant coated bars into a finished product.

13. The process of claim 12 with said end surfaces of said metal bars being transversely spaced to provide said distance of between around 0.07" to about 0.20".

14. The process of claim 12 with said end surfaces of said metal bars being laterally spaced to provide said distance of between 0.07" to around 0.20".

15. The process of claim 12 with said end surfaces of said metal bars being laterally spaced to provide said distance of between 0.07" to around 0.20", a group of at least three of said metal bars to immediate sequence being laterally spaced said distance in a step fashion.

16. The process of claim 5 with the maximum overall lateral spacing between said end surfaces of said bars in said group being no greater than between around $\frac{3}{8}''$ and $\frac{5}{8}''$.

17. The process of claim 12 with said side surfaces having a coating thereon adapted to resist adherence of thermal spray material from said first and second thermal sprays.

18. The process of claim 12 with said metal bars being tranversely spaced by spacers extending longitudinaly generally co-extensively with said metal bars.

19. The process of claim 12 with said metal bars being transversely spaced by spacers extending longitudinally generally co-extensively with said metal bars, said spacers exposed surfaces open to said thermal spray which are adapted to resist adherence of thermal spray material from said thermal spray.

20. The process of claim 12 with said metal bars being transversely spaced by spacers extending longitudinally generally co-extensively with said metal bars, said spacers having exposed surfaces open to said thermal spray which are adapted to resist adherence of thermal spray material from said thermal spray, said spacers comprising a metal strap with a spray resistant coating supported thereon to define said exposed surfaces.

21. The process of claim 12 comprising moving means for causing relative movement between adjacent ones of said bars during application of said thermal spray.

22. The process of claim 12 comprising moving means for causing relative movement between adjacent ones of said bars during application of said thermal spray, said moving means applying said relative movement laterally between said adjacent bars whereby bridging of said metallic coat across said adjacent ones of said bars is inhibited.

23. A process for forming metal bars with a non-skid coating on the narrow end surfaces of the metal bars comprising the steps of providing a plurlity of longitudinally extending metal bars each having side surfaces and a top end surface to be coated, with said end surface having a thickness in a range of between around ⅛" to around 1", arranging said metal bars in an assembly having an overall width greater than around 24" with said bars being oriented in a side by side relationship with each of said end surfaces being exposed in the same direction, applying a metallic coat on said end surfaces by a thermal spray, causing relative movement between adjacent ones of said bars during application of said thermal spray whereby bridging of said metallic coat across adjacent ones of said bars is inhibited.

24. The process of claim 23 with said relative movement being lateral movement between said adjacent bars.

25. The process of claim 23 with said relative movement being longitudinal movement between said adjacent bars.

26. The process of claim 23 with said relative movement between said adjacent bars being continuous during movement through said thermal spray.

27. The process of claim 12 with said adjacent ones of said metal bars being tranversely spaced from each other by spacers extending laterally above said end surfaces a distance of at least around 0.07" to around 0.200", and with said spacers having exposed surfaces to said thermal spray which are adapted to resist adherence of the thermal spray material therefrom.

28. The process of claim 12 with said adjacent ones of said metal bars being transversely spaced from each other by spacers extending laterally above said end surfaces a distance at least between around 0.150" to around 0.300", applying a coat of grit onto said end surfaces between said spacers, applying at least one of said metallic coatings by said thermal spray means over said grit coat and said end surfaces, and said spacers having exposed surfaces to said thermal sprays which are adapted to resist adherence of the thermal spray material therefrom.

29. The process of claim 28 in which the depth of the grit coat is controlled to be generally uniform by a combing apparatus located between said spacers.

30. The process of claim 28 in which the depth of the grit coat is controlled to be generally uniform by a combing apparatus located between said spacers, the depth of the grit coat being controlled relative to the lateral width of each of said bars to provide said bars to be of a generally uniform width relative to each other.

* * * * *

UNITED STATES PATENT AND TRADEMARK OFFICE

CERTIFICATE OF CORRECTION

PATENT NO. : 4,618,511

DATED : October 21, 1986

INVENTOR(S) : William S. Molnar

It is certified that error appears in the above-identified patent and that said Letters Patent is hereby corrected as shown below:

Col. 1, line 11, delete "surfaces" and substitute therefor --surface--.
Col. 1, line 12, after "particularly" insert --to--.
Col. 2, line 9, before "non-skid" insert --a--.
Col. 2, line 27, after "that" insert --as--.
Col. 2, line 60, delete "purpose" and substitute therefor --purposes--.
Col. 2, line 68, delete "about" and substitute therefor --around--.
Col. 3, line 15, delete "substances" and substitute therefor --substance--.
Col. 5, line 36, delete "*".
Col. 6, line 4, after ".07"" insert --to around .20"--.
Col. 6, line 25, delete "occured" and substitute therefor --occurred--.
Col. 6, line 32, delete "temperature" and substitute therefor --temperatures--.
Col. 7, line 8, claim 1, delete "relationhip" and substitute therefor --relationship--.
Col. 7, line 49, claim 8, after "said" insert --metal--.
Col. 7, line 64, claim 10, after "movement" insert --between--.
Col. 8, line 40, claim 13, delete "about" and substitute therefor --around--.
Col. 8, line 47, claim 15, delete "to" and substitute therefor --in--.
Col. 8, line 58, claim 18, delete "tranversely" and substitute therefor --transversely--.
Col. 9, line 20, claim 23, delete "plurlity" and substitute therefor --plurality--.

Signed and Sealed this

Third Day of February, 1987

*Attest:*

*Attesting Officer*

DONALD J. QUIGG

*Commissioner of Patents and Trademarks*